United States Patent [19]

Zaltzman et al.

[11] 4,322,287

[45] Mar. 30, 1982

[54] FLUIDIZED BED SEPARATOR

[75] Inventors: Arthur Zaltzman; Amos Mizrach; Zeev Schmilovitz, all of Beith Dagan, Israel

[73] Assignee: The State of Israel, Ministry of Agriculture, Jerusalem, Israel

[21] Appl. No.: 265,820

[22] Filed: May 21, 1981

[51] Int. Cl.[3] ..... B03B 5/46

[52] U.S. Cl. ..... 209/44; 209/474; 209/492

[58] Field of Search ..... 209/474–476, 209/466–469, 454–457, 172–173, 44, 17, 492

[56] References Cited

U.S. PATENT DOCUMENTS

| | | | |
|---|---|---|---|
| 2,303,367 | 12/1942 | Kendall et al. | 209/44 |
| 3,364,035 | 1/1968 | Belk | 209/173 X |
| 3,367,501 | 2/1968 | Eveson | 209/467 |
| 3,471,016 | 10/1969 | Eveson et al. | 209/474 X |
| 4,194,971 | 3/1980 | Beeckmans | 209/476 X |

*Primary Examiner*—Ralph J. Hill

*Attorney, Agent, or Firm*—Browdy and Neimark

[57] ABSTRACT

A fluidized bed apparatus for separating and sorting solid bodies of different densities. It comprises:

a container for the fluidized bed;

means for maintaining the bed in a state of fluidization under constant pneumatic pressure;

a conveyor whose inner face is adapted for lifting objects out of the bed (lifting conveyor) designed to travel between a lower portion of the bed and the space above it forming an enclosure of substantially rectangular prismatic shape with horizontal and vertical sides, the fluidized bed portion within said enclosure constituting a separation zone whose bottom is formed by the lower horizontal portion of the lifting conveyor;

a first output conveyor for the removal of the sink fraction travelling through the space above the bed inside said enclosure and adapted to receive objects dumped by the lifting conveyor;

a second output conveyor adapted for the removal of the float fraction;

means for mechanically moving the float fraction in the bed out of the separation zone in a direction substantially normal to the direction of horizontal travel of said lifting conveyor; and means for feeding into the separation zone a mixture of objects to be separated.

8 Claims, 2 Drawing Figures

FLUIDIZED BED SEPARATOR

The present invention relates to apparatus for separating and sorting solid bodies of different densities by the use of a fluidized bed. One example of the application of the present invention is the separation of agricultural products from waste material.

For the purpose of separation of solid bodies of different densities a fluidized bed behaves in a manner analogous to a liquid and consequently such separation is of the kind known as sink-float separation. In this kind of separation pieces of solid material less dense than the apparent density of the fluidized bed will float on the surface thereof while pieces of solid material which are more dense than the apparent density of the fluidized bed will sink to the bottom of the vessel. Thus the apparent density of the fluidized bed has to be intermediary between the densities of the float and sink fractions and the particle size of the bed-forming material has to be smaller than the size of the bodies of either fraction by many orders of magnitude. For example, for the sink-float separation of potatoes from clots of soil sand may be used as the bed-forming material.

Sink-float fluidized bed separators for solid materials are described in British Pat. No. 946,480. The feature common to the different embodiments illustrated in that patent specification is the fact that both the float and sink fractions are made to move co-directionally across the bed and that the fluidized bed is pulsating by blowing compressed air therethrough in a rapid series of blasts. It has been found that such techniques impair the separation capacity of the apparatus with the consequence that none of the apparatus illustrated in the said British patent specification is used in practice.

Figure 1:
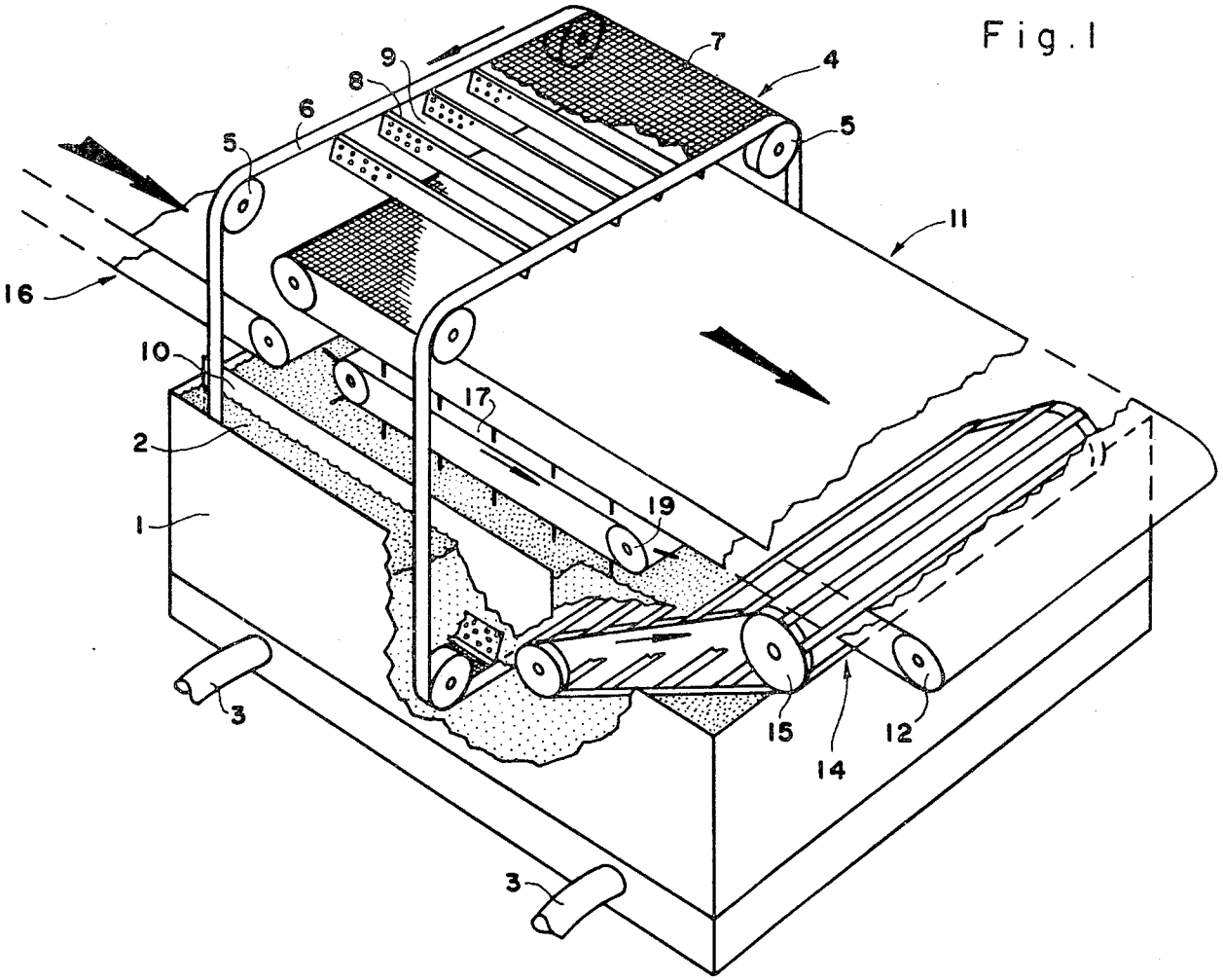

Thus, the device according to FIG. 1 of British Pat. No. 946,480 is characterized by the entire fluidized bed being reconstituted continuously on a horizontal stretch of a conveyor. The bed travels on this conveyor for the length of this horizontal stretch and at the end of such travel the bed-forming material is dumped down to the bottom of the vessel from where it is lifted back onto the conveyor for re-fluidization and performance of a new horizontal travel. In addition to the inherent poor separation power of any apparatus constructed in accordance with the teachings of British Pat. No. 946,480, already referred to above, this particular embodiment has the additional drawback of losing pressurized air at the edges of the upper horizontal portion of the bed-carrying conveyor. Furthermore, the device is rather cumbersome because of the need to lift the bed-forming material continuously back onto the bed-carrying conveyor.

Figure 2:
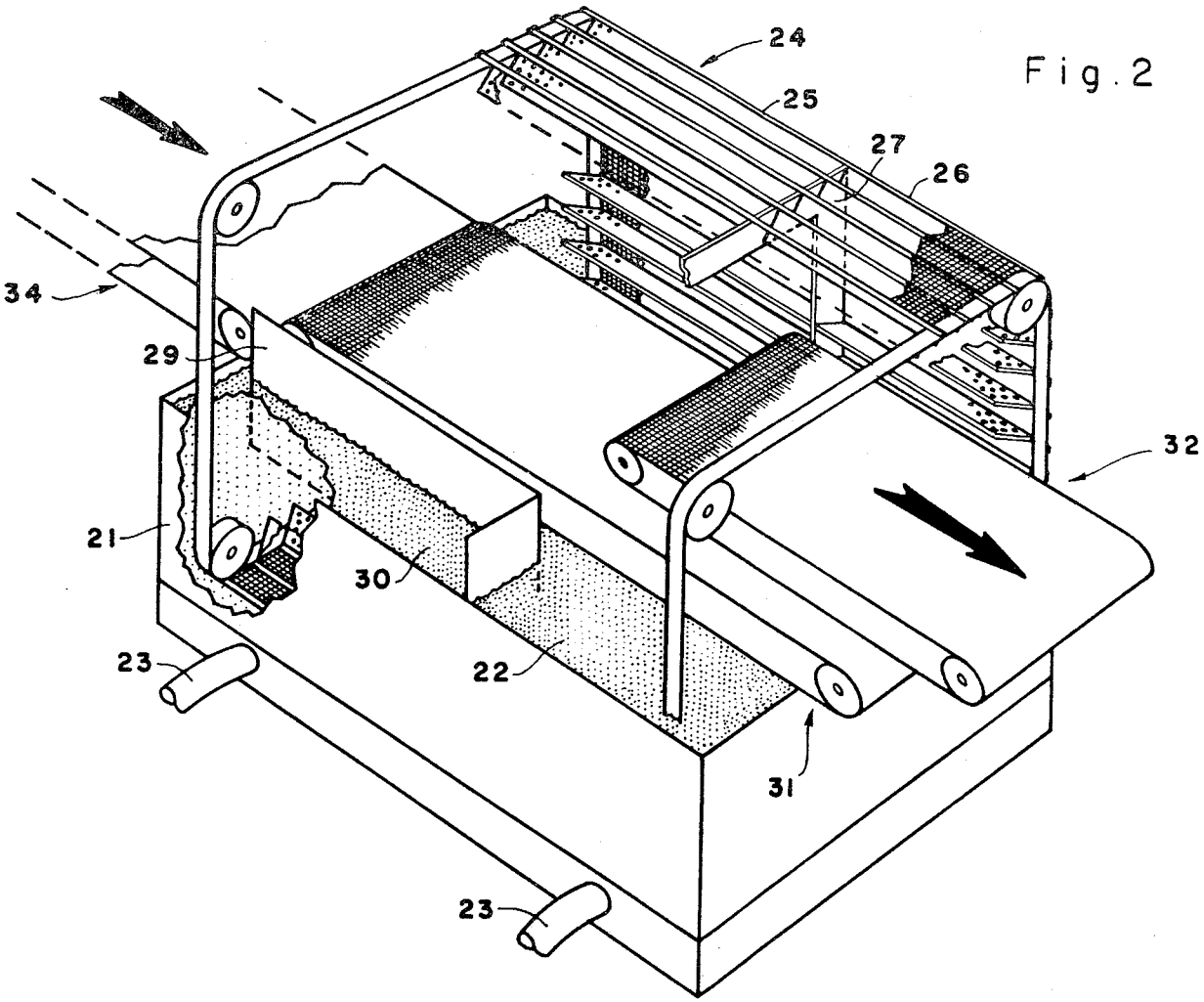

The embodiment illustrated in FIG. 2 of British Pat. No. 946,480 includes a rotary rake containing a plurality of banks of tines which are rotated to inter-mesh with the grid of rods within the fluidized bed for sifting out the lower-density and higher-density solid bodies from the top and bottom of the bed, respectively, and for conveying them to output conveyors. Here again a float and sink fraction travel codirectionally through the fluidized bed and in addition to the poor separation capacity inherent in such an arrangement, again as already mentioned above, this particular embodiment is highly susceptible to jamming by hard bodies becoming lodged between the inter-meshing tines and rods. Furthermore, the scraping of the tines against the air permeable bed base and against the material to be separated cause rapid wear of the tines and of the base, requiring frequent replacement. Moreover, such an arrangement requires a large construction since the angle at which the tines engage the bodies constituting the sink fraction at the base of the fluidized bed must be greater than the angle of repose of these bodies.

In the embodiment of FIG. 3 of British Pat. No. 946,480, the bed-holding vessel is V-profiled and the horizontal motion across the bed is achieved here by creating inside the bed non-uniform pressure gradients in various directions in consequence of uneven distribution of the holes that admit the pressurized air into the bed. Such an uneven distribution, however, gives rise to uncontrollable pressure variations within the bed which further impairs the separation capacity.

It is the object of the present invention to provide a fluidized bed sink-float separator for solid objects having improved separation capacity.

In accordance with the invention there is provided a sink-float fluidized bed separator comprising:

a container for the fluidized bed;

means for maintaining the bed in a state of fluidization under constant pneumatic pressure;

a conveyor whose inner face is adapted for lifting objects out of the bed (lifting conveyor) designed to travel between a lower portion of the bed and the space above it forming an enclosure of substantially rectangular prismatic shape with horizontal and vertical sides, the fluidized bed portion within said enclosure constituting a separation zone whose bottom is formed by the lower horizontal portion of the lifting conveyor;

a first output conveyor for the removal of the sink fraction travelling through the space above the bed inside said enclosure and adapted to receive objects dumped by the lifting conveyor;

a second output conveyor adapted for the removal of the float fraction;

means for mechanically moving the float fraction in the bed out of the separation zone in a direction substantially normal to the direction of horizontal travel of said lifting conveyor; and means for feeding into the separation zone a mixture of objects to be separated.

In accordance with one embodiment of the invention the second output conveyor is adapted to lift the float fraction directly out of the bed.

In accordance with another embodiment of the invention a lifting conveyor is provided to lift the float fraction out of the fluidized bed and to dump it onto the second output conveyor. Such an embodiment thus comprises two lifting conveyors, one for the sink fraction and one for the float fraction and, if desired, these two lifting conveyors may be combined so as to form two sections of one single lifting conveyor.

In the apparatus according to the invention the heavy fraction sinks inside the separation zone onto the lower horizontal portion of the lifting conveyor which carries it first horizontally across the fluidized bed and then lifts it out of the bed and dumps it onto the first output conveyor. At the same time the floating, light fraction is raked in a direction normal to the direction of horizontal travel of the lifting conveyor. Thus, while still in the bed the sink and float fractions move in mutually normal directions which ensures good separation.

In the fludized bed of a separator according to the invention there exists a constant, bottom-to-top, essentially uniform pressure gradient with practically no pressure variation in horizontal direction. In consequence there occurs no uncontrolled migration of objects within the fluidized bed and this too improves the separation capacity.

The separator according to the invention may be built in form of a compact, mobile unit and in this way can be used for in situ separation whereby unnecessary transportation of a reject fraction can be saved.

The invention is illustrated, by way of example only, in the accompanying drawings in which:

FIG. 1 is a perspective view, partly broken open, of a first embodiment of a separator according to the invention; and FIG. 2 is a perspective view, again partly broken open, of a second embodiment of a separator according to the invention.

The separator according to the invention, shown in FIG. 1, comprises a trough-like vessel 1 holding a fluidized bed 2, e.g. of sand. Compressed air is supplied to the bed continuously under constant pressure through a plurality of inlets 3 (only two of which are shown) and in this way a uniform bottom-to-top pressure gradient is maintained inside bed 2.

A lifting conveyor 4 travels over four pairs of rollers 5 (the mounting and drive being conventional and are not shown). It comprises two straps 6 holding a net 7 and a plurality of inward projecting slabs 8 defining between them compartments 9. In this way conveyor 4 is adapted to lift objects of a sink fraction out of the bed 2.

The lower horizontal travel portion of conveyor 4 is submerged in bed 2 inside vessel 1 while the upper horizontal travel portion is outside the bed 2. There is thus formed an enclosure of rectangular prismatic shape comprising a lower, fluidized bed portion which constitutes the separation zone and an upper space portion. Within the separation zone there are fitted two lateral partitions 10 (only one of which is seen in FIG. 1) reaching about half way down into the bed and extending in axial direction of the vessel along the separation zone.

A first output conveyor 11 is mounted on two rollers 12 (the mounting and drive again being conventional and again not being shown) and is adapted to travel in a direction normal to the direction of horizontal travel of conveyor 4 through the upper space portion of the enclosure defined by the conveyor.

A second output conveyor 14 is mounted on two pairs of rollers 15 (the mounting and drive again not being shown). This conveyor is slanted and leads from within a portion of the fluidized bed 2 that is outside the separation zone to out of bed 2. Means (not shown) are associated with both output conveyors 11 and 14 for receiving separately the delivered sink and float fractions, respectively. Such means may be in the form of receptacles or further conveyors.

A feeder conveyor 16 serves for feeding into the separation zone a mixture of objects for sink-float separation. Underneath output conveyor 11 there is mounted a raking belt 17 adapted to rake the float fraction out of the separation zone in a direction normal to the horizontal travel direction of lifting conveyor 4 towards the second output conveyor 14.

The functioning of the above separator is as follows:

The solid mixture of objects to be separated is fed into the separator by means of feeder conveyor 16 which drops the mixture into the separation zone enclosed by lifting conveyor 4. The sink fraction drops nearly vertically inside the separation zone onto the lower horizontal portion of conveyor 4 and is lifted by the latter and dumped onto the output conveyor 11 by which it is removed.

The float fraction of the mixture fed into the separation zone remains near the surface and is raked out of the separation zone of bed 2 by means of the raking belt 17 in a direction normal to the direction of horizontal travel of lifting conveyor 4, in the direction of the second output conveyor 14, and is lifted by the latter out of bed 2.

The separated sink and float fractions are delivered by the output conveyors 11 and 14 into receptacles or onto further conveyors associated therewith and are thus separately recovered.

Due to the presence of partitions 10 the float fraction is physically prevented from coming into contact with the lifting conveyor 4 and in this way any back mix after separation is avoided.

All three conveyors 4, 11 and 14 are designed to be permeable to the bed-constituting material. Accordingly any such material that is lifted out of the bed together with the output fractions is subsequently returned.

The embodiment of the invention shown in FIG. 2 is essentially similar to the one of FIG. 1. Here again the separator comprises a vessel 21 holding a fluidized bed 22 kept in a state of fluidization by a constant supply of compressed air under constant pressure through a plurality of inlets 23 (only two of which are shown). The apparatus further comprises a lifting conveyor 24 essentially of similar construction as conveyor 4 in FIG. 4 but extending along nearly the entire length of vessel 21. On its inner side the conveyor 24 comprises two sets of slabs 25 and 26 separated from each other by a frame 27 rigidly mounted on vessel 21. The portion of conveyor 24 on the left-hand side (with reference to FIG. 2) of frame 27 is constituted by slabs 25 and encloses a separation zone of the fluidized bed 22, similar as in FIG. 1. Within the separation zone and co-extensive therewith there extend again two lateral partitions 29 (only one of which is seen in FIG. 2) reaching each about half way down into bed 22 and being each bent at the end of the separation zone, approximately underneath frame 27, at right-angle, in the manner shown. In this way, two compartments 30 are formed between the partitions 29 and the associated wall portion of vessel 21 which are inaccessible to the float fraction and in this way any back mix of the separated fractions is prevented. The zone of bed 22 beyond the bent ends of partitions 29 is enclosed by the right-hand side section of lifting conveyor 24 (slabs 26) and in this section the float fraction can move towards slabs 26 of lifting conveyor 24.

Associated with lifting conveyor 24 is a first output conveyor 31 for the sink fraction and a second output conveyor 32 for the float fraction. The output conveyors 31 and 32 are staggered relative to each other in such a way that only conveyor 31 travels through the space enclosed by the lefthand side section (slabs 25) of lifting conveyor 24 whilst the second output conveyor 32 for the float fraction travels only through the space enclosed by the right-hand side section (slabs 26) of lifting conveyor 24 above conveyor 31.

A feeder conveyor 34 serves for feeding the misture to be separated into the separator. Furthermore, like in the embodiment of FIG. 1, this embodiment as well comprises raking means (not shown), e.g. a raking belt, for raking the float fraction out of the separation zone in a direction essentially normal to the direction of horizontal travel of lifting conveyor 24.

Also in this Figure the various mountings of the conveyor rollers and their drives, all of which are conventional, are not shown. Furthermore, here again means such as receptacles or conveyors (not shown) are associated with the output conveyors 31 and 32 for receiving separately the sink and float fractions.

The functioning of this embodiment is briefly as follows:

The mixture of solid objects to be separated is fed by feeder conveyor 34 into the separation zone. The sink fraction is lifted out of bed 22 by the lefthand side section of conveyor 24 (slabs 25) and is dumped by it on the first output conveyor 31 in a manner similar to that described with reference to FIG. 1. Conveyor 31 removes the sink fraction out of the apparatus and drops it into an associated receptacle or onto an associated conveyor (not shown).

The float fraction travels horizontally with the aid of the raking means (not shown) out of the separation zone in a direction normal to the direction of horizontal travel of conveyor 24, until it reaches the zone of bed 22 enclosed by the right-hand side section (slabs 26) of the lifting conveyor 24. In this zone the accumulating float fraction expands laterally and comes into contact with the right-hand side section (slabs 26) of the lifting conveyor 24 and is lifted thereby out of bed 22 and dumped onto the second output conveyor 32 in a manner similar to the lifting and dumping of the sink fraction by slabs 25. Conveyor 32 delivers the float fraction to associated collecting means (not shown) and in this way the sink and float fractions are separately recovered.

We claim:

1. A sink-float fluidized bed separator comprising:

a container for the fluidized bed;

means for maintaining the bed in a state of fluidization under constant pneumatic pressure;

a conveyor whose inner face is adapted for lifting objects out of the bed (lifting conveyor) designed to travel between a lower portion of the bed and the space above it forming an enclosure of substantially rectangular prismatic shape with horizontal and vertical sides, the fluidized bed portion within said enclosure constituting a separation zone whose bottom is formed by the lower horizontal portion of the lifting conveyor;

a first output conveyor for the removal of the sink fraction travelling through the space above the bed inside said enclosure and adapted to receive objects dumped by the lifting conveyor;

a second output conveyor adapted for the removal of the float fraction;

means for mechanically moving the float fraction in the bed out of the separation zone in a direction substantially normal to the direction of horizontal travel of said lifting conveyor; and means for feeding into the separation zone a mixture of objects to be separated.

2. A separator according to claim 1 wherein the second output conveyor is adapted to lift the float fraction directly out of the fluidized bed.

3. A separator according to claim 1 comprising a second lifting conveyor for lifting the float fraction out of the fluidized bed and adapted to deliver it to the second output conveyor.

4. A separator according to claim 3 comprising a single lifting conveyor divided into two sections, one associated with the separation zone and adapted to lift the sink fraction out of the fluidized bed and another associated with a zone of the fluidized bed outside the separation zone and adapted to lift the float fraction out thereof.

5. A separator according to claim 1 comprising partitions within the separation zone adapted to prevent any back mix of the float and sink fractions.

6. A separator according to claim 5 wherein said partitions are so shaped that between each of them and the associated vessel wall there is formed a confined compartment inaccessible by the float fraction.

7. A separator according to claim 1 wherein said lifting and output conveyors are permeable to the bed-forming material.

8. A separator according to claim 1 designed as a mobile unit.

* * * * *